US005685757A

United States Patent [19]

Kirsch et al.

[11] Patent Number: 5,685,757

[45] Date of Patent: Nov. 11, 1997

[54] FIBROUS SPUN-BONDED NON-WOVEN COMPOSITE

[75] Inventors: Andreas Kirsch, Bockenem; Gerhard Knitsch, Wedemark; Heinz-H. Boich, Peine, all of Germany

[73] Assignee: Corovin GmbH, Peine, Germany

[21] Appl. No.: 111,539

[22] Filed: Aug. 25, 1993

Related U.S. Application Data

[63] Continuation-in-part of Ser. No. 892,685, May 27, 1992, abandoned, which is a continuation-in-part of Ser. No. 540,221, Jun. 18, 1990, abandoned.

[30] Foreign Application Priority Data

Jun. 20, 1989 [DE] Germany ..... 39 20 066.3

[51] Int. Cl.[6] ..... D04H 5/00

[52] U.S. Cl. ..... 442/344; 442/351; 442/401; 428/903

[58] Field of Search ..... 428/903; 442/344, 442/351, 401

[56] References Cited

U.S. PATENT DOCUMENTS

| | | | |
|---|---|---|---|
| 3,768,118 | 10/1973 | Ruffo et al. . | |
| 4,041,203 | 8/1977 | Brock et al. . | |
| 4,118,531 | 10/1978 | Hauser | 428/224 |
| 4,525,411 | 6/1985 | Schmidt | 428/198 |
| 4,714,647 | 12/1987 | Shipp et al. . | |
| 4,725,473 | 2/1988 | Gompel et al. . | |
| 4,751,134 | 6/1988 | Chenoweth et al. . | |
| 4,910,064 | 3/1990 | Sabee . | |
| 4,950,531 | 8/1990 | Radwanski . | |
| 5,145,727 | 9/1992 | Potts et al. . | |

FOREIGN PATENT DOCUMENTS

| | | |
|---|---|---|
| 1278659 | 1/1991 | Canada . |
| 3521221 | 12/1986 | Germany . |
| 3920066 | 1/1991 | Germany . |

*Primary Examiner*—Kathleen Choi

*Attorney, Agent, or Firm*—Burns, Doane, Swecker & Mathis, L.L.P.

[57] ABSTRACT

A novel fibrous non-woven composite is provided that comprises as a first component substantially continuous coarse spun-bonded filaments of a thermoplastic polymer which exhibit molecular orientation, and as a second component fine discontinuous melt-blown microfibers of a thermoplastic polymer. The fibrous components are well admixed through their placement following their formation on the same equipment to form an integrated non-woven deposition in the absence of a discrete phase boundary between substantially homogeneous concentrations of the components, and are subsequently thermally bonded to form a unitary structure. The continuous coarse spun-bonded filaments provide good strength for a supporting function throughout the non-woven composite, and the fine discontinuous melt-blown microfibers perform an uninterrupted filtration and/or moisture transport function throughout the non-woven composite. The resulting product is useful in diaper, medical, and clothing applications.

1 Claim, 4 Drawing Sheets

FIBROUS SPUN-BONDED NON-WOVEN COMPOSITE

CROSS REFERENCE TO RELATED APPLICATIONS

This is a Continuation-in-Part Application of Ser. No. 07/892,685, filed May 27, 1992, now abandoned which is a Continuation-in-Part application of Ser. No. 07/540,221, filed Jun. 18, 1990 now abandoned.

BACKGROUND OF THE INVENTION

Fibrous composites are known. They commonly consist of several preformed discrete layers of non-woven materials which are bonded or otherwise laminated together.

Needle-felt floor coverings for example are conventionally manufactured from at least two non-woven sheets or layers that differ in fiber fineness, and color. Thereby combinations of properties can be attained that would be extremely difficult or even impossible to achieve in a single layer of a spun-bonded non-woven material.

Non-woven goods that are employed as inserts in the clothing industry are also known to be manufactured in the form of composites, as are many specialized filters and medical dressings. The latter are often made from separate preformed non-wovens of continuous filaments and microfibers and are joined in surface-to-surface contact to form a composite.

German Patent No. 2,356,720 and U.S. Pat. No. 4,041,203 to Brock et al. disclose such a two-layered composite. This structure comprises a non-woven layer of molecularly oriented continuous filaments of a thermoplastic polymer having a mean diameter of more than 12 μm bonded in surface-to-surface contact to a previously thermally-bonded non-woven layer of short fibers of a thermoplastic polymer having a mean diameter of less than 10 μm. The latter layer comprises a microfiber non-woven of discontinuous thermoplastic fibers having a softening temperature 10° to 40° C. lower than that of the filaments in the former layer. The non-woven layer of molecularly oriented continuous filaments is point-bonded by the application of heat and pressure to the microfiber layer in laminar surface-to-surface contact. The resulting product exhibits a textile-like appearance and drape. The layer of continuous molecularly oriented filaments serves a supporting function for the adjoining microfiber layer. This known composite is manufactured by combining the as yet uncompacted continuous-filament non-woven layer with the previously compacted microfiber non-woven layer, which is obtained from a roll, upstream of the compacting calender as illustrated in FIG. 2 of German Patent No. 2,356,720 and U.S. Pat. No. 4,041,203. The microfiber non-woven layer is accordingly already consolidated before being laminated and bonded to the continuous filament non-woven layer and has enough mechanical stability to withstand being stored in a roll and to withstand being unwound from the roll prior to being formed into a composite of the two discrete homogeneous layers. Thus the laminated composite is compacted with a calender to produce bonding once the loose and uncompacted continuous-filament non-woven layer and the already consolidated microfiber non-woven layer are placed in a side-by-side relationship. It is an essential characteristic of this known composite that the resulting laminated structure consists of individual discrete layers separated by a definite phase boundary between substantially homogeneous concentrations of the two components. The purpose of such multilayer composites with phase boundaries in their cross-section is to attempt to combine the properties and functions of the individual and discrete non-woven layers for particular applications. The molecularly oriented continuous-filament non-woven layer of the composite disclosed in German Patent No. 2,356,720 and U.S. Pat. No. 4,041,203 is intended to act as a base, whereas the microfiber non-woven layer is intended to function primarily as an absorbent or filter. A composite is formed that is mechanically stable with the base of continuous filaments supporting the discrete layer of microfibers which can absorb moisture.

Such a composite nevertheless has been found to possess shortcomings. One particular disadvantage is that the function of each layer within the composite is confined to a single homogeneous layer and cannot be exerted as a whole throughout the cross-section of the composite. Assume, for example, that the microfiber non-woven layer of the composite is intended to absorb or transport moisture. Such microfiber non-woven layer is usually thinner than the filament non-woven layer, which acts as a base. To increase the filtering capacity of the microfiber non-woven layer it would be necessary to attempt to make it much thicker, which would introduce the drawback of slowing the filtration. Accordingly, the possible designs for satisfactory end uses are somewhat limited when following this technology.

It is an object of the present invention to provide an improved fibrous non-woven composite article having a novel internal structure that was not available in the prior art.

It is another object of the present invention to provide a novel non-woven composite article in which the support and absorptive properties of its components advantageously are manifest throughout its cross-section.

These and other objects, as well as the scope, nature, and utilization of the claimed invention will be apparent to those skilled in the art from the following detailed description and appended claims.

SUMMARY OF THE INVENTION

It has been found that a fibrous non-woven composite comprises in admixture:

(a) as a first component substantially continuous coarse spun-bonded filaments of a thermoplastic polymer which exhibit molecular orientation, and (b) as a second component fine discontinuous melt-blown microfibers of a thermoplastic polymer, wherein the first and second components of the fibrous non-woven composite were deposited following melt extrusion on the same equipment to produce an admixture of said components in the absence of a discrete phase boundary between substantially homogeneous concentrations of the components thereby creating an integrated non-woven deposition of the components, and the integrated non-woven deposition of the components subsequently was thermally bonded to form the non-woven composite which exhibits a unitary structure.

DESCRIPTION OF PREFERRED EMBODIMENTS

Figure 1:
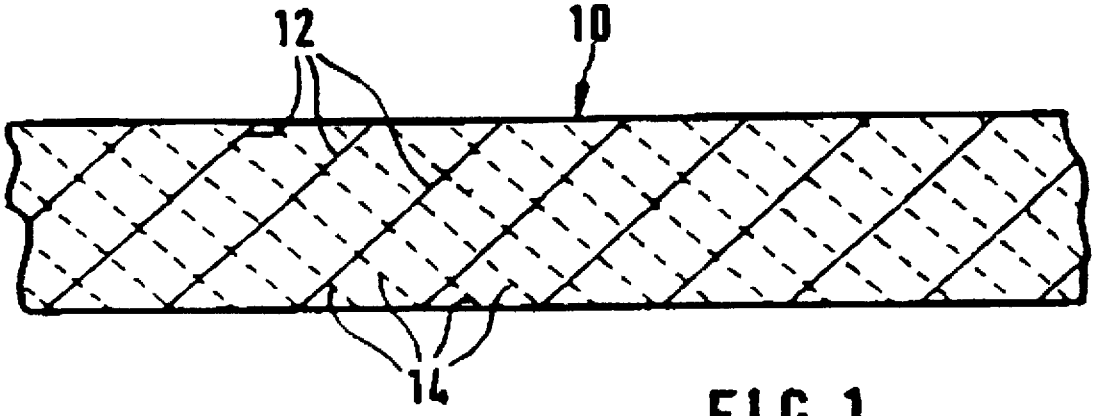
FIG. 1 is a schematic sectional view of a fibrous non-woven composite in accordance with the present invention wherein the continuous coarse spun-bonded filaments of component (a) and the fine discontinuous melt-blown microfibers of component (b) are indicated to be in admixture throughout the thickness of the composite.

The present invention provides a novel fibrous non-woven composite comprising substantially continuous coarse spun-bonded filaments of a thermoplastic polymer which exhibit molecular orientation in admixture with fine discontinuous melt-blown microfibers of a thermoplastic polymer wherein there is an absence of a discrete boundary between substantially homogeneous concentrations of the components. Since each fibrous component is melt extruded and is deposited with intimate commingling on the same equipment (e.g., layering machine), a more or less uniform mixture of coarse spun-bonded filaments and fine melt-blown microfibers is accomplished on an expeditious basis prior to thermal bonding to form the resulting composite article.

Any thermoplastic polymer that is capable of melt extrusion to form fibers may be utilized to form the fibrous non-woven composite of the present invention. For instance, the thermoplastic polymer may be polyethylene, polypropylene, polyethylene terephthalate, polyamides, polyurethane, polystyrene, copolymers of the foregoing, etc.

It is significant that the discontinuous melt-blown microfibers are mixed with the coarse continuous spun-bonded filaments without utilizing any intermediate compaction of the same. Accordingly, the layer of discontinuous melt-blown microfibers is not compacted prior to composite formation as is practiced in the prior art. This different formation technique has been found to lead to the formation of a novel product having advantageous overall properties.

The product of the invention accordingly is a composite comprising at least two fibrous components (i.e., spun-bonded coarse continuous filaments and fine discontinuous melt-blown microfibers) whereby no individual homogeneous layers can be detected within the same and no discrete phase boundaries are present between substantially homogeneous concentrations of the components because the material is of an integrated unitary construction.

The fibrous non-woven composite of the present invention can be distinguished from that of German Patent No. 2,202,955 and U.S. Pat. No. 3,768,118 wherein a method is disclosed for manufacturing a tangled non-woven web of two different discontinuous fibers. The fibers in this prior art method are first broken down into separate fibers by two intake grids and are supplied by two high-speed converging streams of air to a mixing point. The individual fibers intersect and penetrate one another in the mixing zone, and the mixture is layered into a tangled non-woven composite on an air-permeable support, such as a layering belt. These short fibers (e.g., wood pulp) are accordingly initially mixed together in a mixing zone before the non-woven composite of exclusively discontinuous fibers is constructed on the air-permeable support. This method utilizes staple fibers, which are discontinuous and short enough to mix at the mixing zone before being layered. See Col. 3, lines 13 to 27 of German Patent No. 2,202,955 and Col. 1, lines 14 to 23 of U.S. Pat. No. 3,768,118 with respect to the lengths of the fibers involved. The "long fibers" there discussed are generally between ½ and 2½ inches, and the "short fibers" have a length less than about one-fourth inch.

The substantially continuous coarse spun-bonded filaments of a thermoplastic polymer utilized in the present invention exhibit a diameter greater than 15 μm, and typically exhibit a diameter of approximately 15 to 25 μm, and most preferably a diameter of approximately 18 to 22 μm. Such coarse continuous filaments can be formed using conventional technology for forming the fibers of a spun-bonded non-woven product. Molecular orientation can be imparted to such coarse continuous filaments immediately following their melt extrusion while utilizing conventional techniques, such as aerodynamic drawing.

The fine discontinuous melt-blown microfibers of a thermoplastic polymer utilized in the present invention exhibit a diameter less than 10 μm, and typically exhibit a diameter of approximately 0.5 to 10 μm, and most preferably a diameter of 2 to 8 μm. The discontinuous microfibers can be formed by conventional technology for forming melt-blown microfibers, such as melt-extrusion followed by subjection to aerodynamic forces which act upon the resulting spinline to create periodic filament breakage and the formation of fine discontinuous melt-blown microfibers. Melt extrusion conditions can be selected for such component which inherently impart no substantial molecular orientation to the resulting melt-blown microfibers, or alternatively conditions which impart molecular orientation can be utilized as will be apparent to those skilled in the formation of melt-blown microfibers.

Depending on the desired end use, the fibrous non-woven composite of the present invention commonly comprises 20 to 97 percent by weight of the substantially continuous coarse spun-bonded filaments of thermoplastic polymer, and 3 to 80 percent by weight for the fine discontinuous melt-blown microfibers. For many end uses, it has been determined that the preferred concentrations can range from 40 to 97 percent by weight for the substantially continuous coarse spun-bonded filaments, and from 3 to 60 percent by weight for the fine discontinuous melt-blown microfibers. The percent by weight for each component is based upon the total weight of the fibrous non-woven composite of the present invention.

The difference in properties between the continuous coarse spun-bonded filaments as employed in the present invention versus both the "short" and "long" discontinuous fibers of the prior art as previously discussed is self-evident. However, even the fibers of the second component employed in the present invention and referred to as "microfibers" are not comparable in length to the "long" or "short" fibers of the prior art previously discussed. More specifically, the discontinuous melt-blown microfibers utilized in the present invention can be several 100 mm. in length. Typically, such melt-blown microfibers have lengths of approximately 200 to 1000 mm., or more, with the exact length of such discontinuous microfibers not being critical to the achievement of the desired properties discussed herein. As will be apparent to those skilled in fiber technology, if the lengths of the melt-blown discontinuous microfibers are too short, their movement may be difficult to control and they may be blown away from the contemplated area for admixture during composite formation thereby having a deleterious impact upon the overall productivity. Accordingly, extremely short melt-blown microfiber lengths are avoided in preferred embodiments.

The fibrous non-woven composite product of the present invention could not be formed while utilizing the teachings of U.S. Pat. No. 3,768,118 or its equivalent, German Patent No. 2,202,955, to Ruffo et al. It would not be possible to deposit the continuous coarse filaments utilized herein by employing the fiber laying device as described in this prior art. If such continuous coarse filaments were transported on rotating feed rolls as described in the prior art, the continuous filaments would tend to stick to these rolls, and would roll up. Accordingly, they would not be forwarded to the collector screen as desired in such prior technology. See Col. 18, lines 3 to 43, of U.S. Pat. No. 3,768,118 where the rayon fiberizing system shown on right side of FIG. 1 of that patent is described. The rayon is provided in the form of a carded batt of staple fibers (335). If one chose to utilize continuous filaments which is not even remotely suggested, they would have to be introduced in the form of a flat sheet which would be the only form having some geometrical similarity to the carded batt used in the reference. Such flat sheet would be positively directed to the clothing of the rayon lickerin (338). The continuous filaments would be positively maintained in position relative to the feed roll (337) until the fibers would contact the teeth (339) of the rayon lickerin (338). However, due to their continuous nature, the continuous filaments could never be effectively combed from the surface of the flat sheet which served as their source. Instead, they would simply be broken or caused to disintegrate as the rayon teeth of the lickerin are rotated on shaft (341) at a high speed (e.g., 3,000 rpm as stated at Col. 18, line 28). The resulting fibrous product would always consist of irregular and short fibers (i.e., staple fibers) and would be forwarded to the forming area. It could not reasonably be expected that a process involving disintegration of the continuous filaments by means of the rayon lickerin (338) could possibly lead to fibrous non-woven composite of the present invention. A portion of the continuous filaments would always stick to the teeth (339) of the rayon lickerin (338). These would remain caught in the teeth and would cause a continuous build-up of a non-uniform layer on its surface thereby necessitating mandatory stoppage of the equipment which would have to be frequently serviced by cleaning. However, the essential difference relative to the present invention would reside in the fact that the resulting prior art product, if ever capable of being manufactured while utilizing continuous filaments as a starting material, would always be formed from staple fibers rather than from coarse spun-bonded continuous filaments and fine melt-blown microfibers as presently claimed.

The use of the molecularly oriented coarse spun-bonded continuous filaments as one of two fiber components within the composite of the present invention has been found to provide important advantages. For instance, the final non-woven fabric is provided with excellent strength characteristics in all directions throughout its structure which would not be possible if all discontinuous fibers were utilized. The use of any combination of "short" and "long" fibers, as defined in the prior art, could never yield such an advantageous strength characteristic as that of the present invention.

The aerodynamic conditions that are created by flowing air that accompanies continuous filaments while they are being extruded under pressure from a liquid melt make it impossible to fully mix diverse fiber types together before they are deposited. However, the fine melt-blown discontinuous microfibers utilized in the present invention also enter into and penetrate void areas within the web comprising the continuous coarse spun-bonded filaments. Cavities between the continuous coarse filaments are thereby filled by the melt-blown microfibers that enter at high velocity.

Again in contrast to the prior art, the filaments utilized to form the product of the present invention are not separated into individual fibers by intake grids and then mixed together in a mixing zone or chamber before being layered. Intake grids would also tend to break the continuous filaments down into short fibers, which would be contrary to the present invention.

Similar distinctions between the presently claimed invention and that of U.S. Pat. No. 4,751,134 to Chenovet apply. The stated object of this prior art patent is to form a "non-woven matrix of glass and synthetic fibers." The two fiber components utilized are defined at Col. 3, lines 35 to 46, and at lines 47 to 53, respectively. The first fiber component of this prior art is fiberized glass fibers having a diameter of 3 to 10 microns and widely varying lengths of one-half to 3 inches. The second synthetic fiber component has fiber lengths of one quarter to 4 inches. Even here, in comparison to the present invention, the fibers employed are relatively short and could not yield a product having the desirable strength characteristic which is achieved by the present invention in view of the presence of the coarse continuous filaments in combination with the fine discontinuous microfibers.

One essential characteristic of the product of the present invention is that, due to the resultant good admixture of the diverse spun-bonded and melt-blown components, there is hardly any nonuniformity in the fibrous blend throughout the cross-section of the resulting fibrous non-woven composite. The new fibrous composite accordingly effectively combines the different functions of both types of fiber throughout a cross-section of the product. It should be noted that the good admixture of the two components over the cross-section of the composite serves to extend the operability and function of each component over the total thickness of the resulting fibrous non-woven composite.

Accordingly, the function of the fine discontinuous melt-blown microfibers is substantially distributed over the entire cross-section of the composite, as is the supporting function of the relatively coarse continuous spun-bonded filaments of the thermoplastic polymer which exhibit molecular orientation. The prescribed mixture of the individual components well facilitates the function of each component at all areas of the resulting fibrous non-woven composite and, in contrast to the prior art, there are no phase boundaries between layered components that are present in substantially homogeneous concentrations.

The new composite article of the present invention makes it possible for the first time to render each function ascribed to the diverse components more or less homogeneously over the total cross-section of the fibrous composite whereas in the prior art, the functions ascribed to the individual components are limited to each separate layer.

Since the individual components are intermixed throughout the cross-section in accordance with the invention, the components can now also carry out the particular functions assigned to them throughout a substantially thicker are. For example, one function of the fine discontinuous microfibers is to filter or transport moisture. Since the intermixed discontinuous microfibers are distributed throughout the thickness of the fibrous composite, the filtration area is expanded and filtration will be more rapid. Also, the transport of moisture is not interrupted.

The present invention provides a further advantage. The mixing of the two components together, makes it possible to preliminarily compact to some degree the composite-forming components during the integrated non-woven deposition of the components on a support (e.g., a continuous belt) on the same equipment immediately following melt extrusion. This preliminary compaction that inherently occurs well facilitates the conveying of the mixture in a preferred embodiment to a bonding calender for thermal pattern or point-bonding through the simultaneous application of heat and pressure. Accordingly, it is no longer necessary to take steps to achieve a desired level of compactness before the composite can be forwarded to the calender where bonding is accomplished.

Turning now in detail to the drawings, the schematic sectional view of FIG. 1 represents a fibrous non-woven composite 10 comprising a mixture of the coarse continuous spun-bonded filaments of thermoplastic polymer 12 and the fine discontinuous melt-blown microfibers of thermoplastic polymer 14. In order to demonstrate that the fibrous non-woven composite 10 has no discrete layers of individual components separated by phase boundaries and is actually a substantially homogeneous mixture of the two components, coarse continuous spun-bonded filaments 12 are represented in the drawing by continuous hatching and the fine discontinuous melt-blown microfibers 14 are represented by broken hatching. Both the molecularly oriented and substantially continuous coarse spun-bonded filaments 12 and the fine discontinuous melt-blown microfibers 14 extend substantially throughout the total thickness of the fibrous non-woven composite 10 which exhibits a unitary construction in the absence of phase boundaries created by the lamination of diverse components. The continuous coarse spun-bonded filaments 12 serve as a reliable strong support and the fine discontinuous melt-blown microfibers 14 serve a filtering and moisture transport function throughout the cross-section of the fibrous non-woven composite.

The filtration and moisture transport component in the form of fine discontinuous melt-blown microfibers 14 is accordingly distributed throughout the total cross-section thereby making it possible to attain more extensive and more rapid filtration than would be possible with one or more thin discrete homogeneous filtration layers of such melt-blown microfibers. The supporting function of the continuous coarse spun-bonded filaments 12 also extends throughout the cross-section of the fibrous non-woven composite 10.

The fibrous non-woven composite 10 is produced following the melt extrusion of its components in an integrated non-woven production process on the same equipment (i.e., a non-woven laying machine) in a non-woven spinning plant (not shown). Continuous coarse spun-bonded filaments 12 and fine discontinuous melt-blown microfibers 14 are layered together in good admixture in a single sheet following melt extrusion from separate extrusion orifices in the absence of the preliminary formation of two discrete substantially homogeneous concentrations of the components thereby creating an integrated non-woven deposition of the components that is subsequently bonded through the simultaneous application of heat and pressure.

Figure 2:
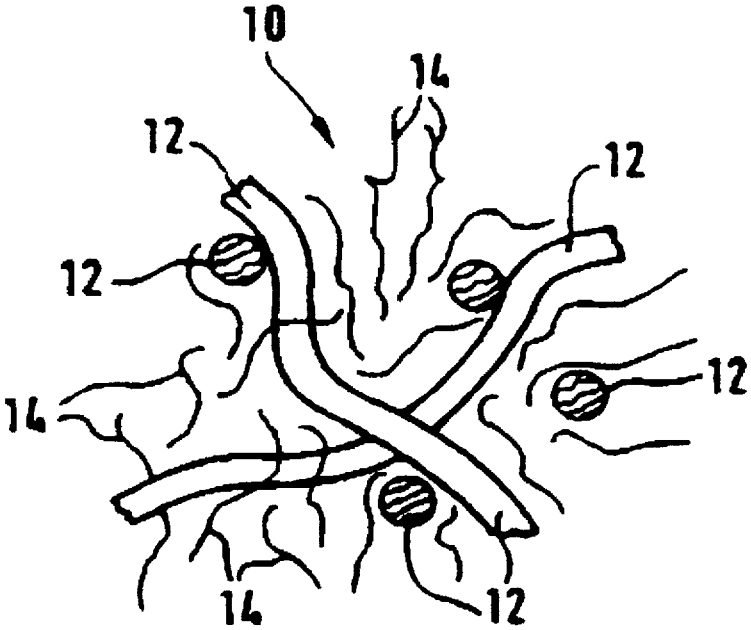
FIG. 2 is an enlarged schematic simplified representation of an area within the non-woven composite of the present invention wherein the disposition with good admixture of the continuous coarse spun-bonded filaments of component (a) and the fine discontinuous melt-blown microfibers of component (b) is apparent.

As will be apparent from the enlarged schematic simplified illustration in FIG. 2, continuous coarse spun-bonded filaments 12 and the fine discontinuous melt-blown microfibers 14 are blended into a substantially homogeneous admixture. The fine discontinuous melt-blown microfibers 14 extensively fill and occupy the spaces between the comparatively thicker coarse continuous spun-bonded filaments 12 thereby forming a substantially homogeneous unitary mass of the diverse fibrous components. The good admixture of diverse fiber components that constitutes the fibrous non-woven composite 10 is created through melt extrusion and disposition on a common support without previously subjecting the individual components (i.e., the continuous coarse spun-bonded filaments 12 and/or the fine discontinuous melt-blown microfibers 14) to a preliminary compaction.

The substantially continuous coarse spun-bonded filaments of thermoplastic polymer which exhibit molecular orientation that constitute the supporting matrix of the fibrous non-woven composite 10 can be conventionally spun via melt extrusion. As previously indicated, the fine discontinuous microfibers 14 can be advantageously produced by the use of conventional procedures used to form fine melt-blown discontinuous fibers. The exertion of aerodynamic forces on the extrudate preferably is adjusted so as to decrease the frequency of fiber breakage and to thereby form longer lengths of the resulting discontinuous microfibers than otherwise would be formed during such melt-blowing.

The following Example is presented as a specific illustration of the present invention. It should be understood, however, that the invention is not limited to the specific details set forth in the Example.

EXAMPLE

Figure 3:
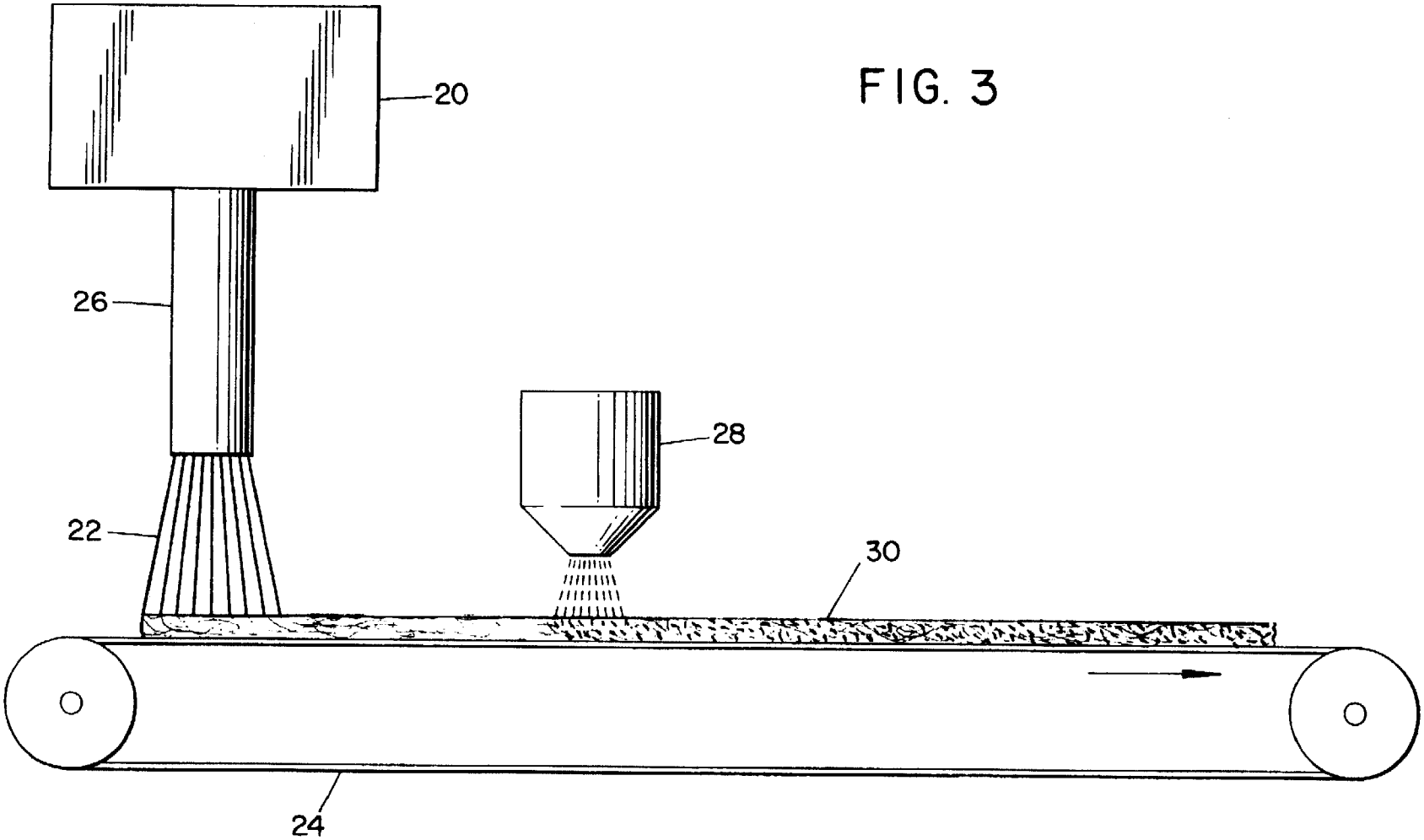
FIG. 3 illustrates schematically an arrangement of equipment for use during the formation of the fibrous non-woven composite of the present invention prior to conventional thermal point-bonding (not illustrated).
Figure 4:
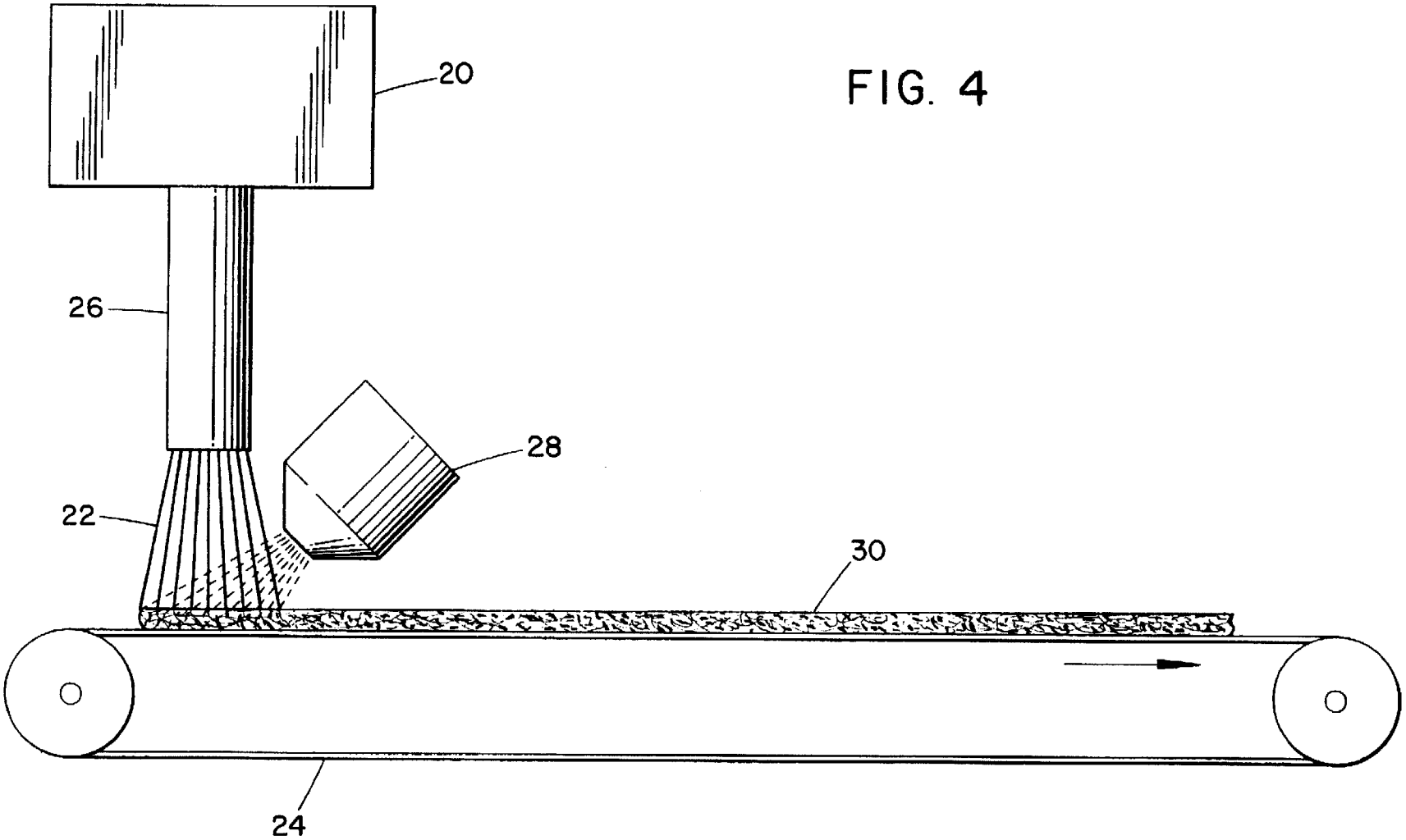
FIG. 4 illustrates schematically another arrangement of equipment for use during the formation of the fibrous non-woven composite of the present invention wherein each fibrous component is deposited substantially simultaneously at the same area of the conveyor belt situated below the extrusion orifices prior to conventional thermal point-bonding (not illustrated). Each element of the equipment arrangement is as described hereafter in conjunction with FIG. 3.

The thermoplastic polymer used to form each of the components of the fibrous non-woven composite is primarily isotactic polypropylene. The polypropylene used to form the continuous coarse spun-bond filaments has a melt flow index of approximately 25 at 230° C. and 2.16 Kg. pressure. The polypropylene used to form fine discontinuous microfibers has a melt flow index immediately prior to extrusion of 800 at 230° C. and 2.16 Kg. pressure. As illustrated in FIG. 3, the melt extrusion spinning equipment 20 for forming continuous coarse spun-bonded filaments 22 is located over a moving foraminous conveyor belt 24 so that the filaments following extrusion from the melt are forwarded perpendicularly to the conveyor. Air is continuously withdrawn from the underside of the conveyor belt 24 by gaseous withdrawal means which produce a zone of reduced pressure (not shown). Approximately 2,500 extrusion orifices are provided for the continuous coarse spun-bonded filaments per meter of production. Immediately following melt extrusion the resulting continuous spun-bonded filaments are substantially molecularly oriented at 26 by aerodynamic drawing at a draw ratio in excess of 200:1. The resulting continuous coarse spun-bonded filaments 22 which exhibit molecular orientation have a diameter of approximately 20 μm. as they are deposited on conveyor 24. The spinning equipment 28 for the fine discontinuous melt-blown microfibers is positioned immediately following spinning equipment 20 and also is directed perpendicularly towards the same conveyor 24. The fine melt-blown microfibers enter into and penetrate void areas of the previously deposited web comprising continuous coarse spun-bonded filaments. Cavities between the continuous coarse spun-bonded filaments are thereby filled by the melt-blown microfibers that enter at high velocity. Approximately 1,000 extrusion orifices are provided for the microfibers per meter of production and the resulting extrudate periodically is broken to form discontinuous microfibers through the adjustment of the aerodynamic velocity of the hot air stream flowing therewith. The fine discontinuous melt-blown microfibers have a diameter of approximately 2 to 6 μm. with some variation among microfibers, and lengths within the range of approximately 200 to 1,000 mm. as they are deposited. The area of the conveyor belt 24 immediately below spinning equipment 20 and 28 constitutes a web-forming area. In this manner a unitary substantially homogeneous sheet of the composite material 30 is formed on a single support having a weight of approximately 25 g./sq. meter. This sheet is next transported by means of the conveyor 24 to a location (not shown) where thermal point-bonding is accomplished by conventional means through the simultaneous application of heat and pressure. The resulting fibrous non-woven composite following thermal point-bonding consists of 50 percent by weight of the continuous coarse spun-bonded filaments and 50 percent by weight of the fine discontinuous melt-blown microfibers.

Figure 5:
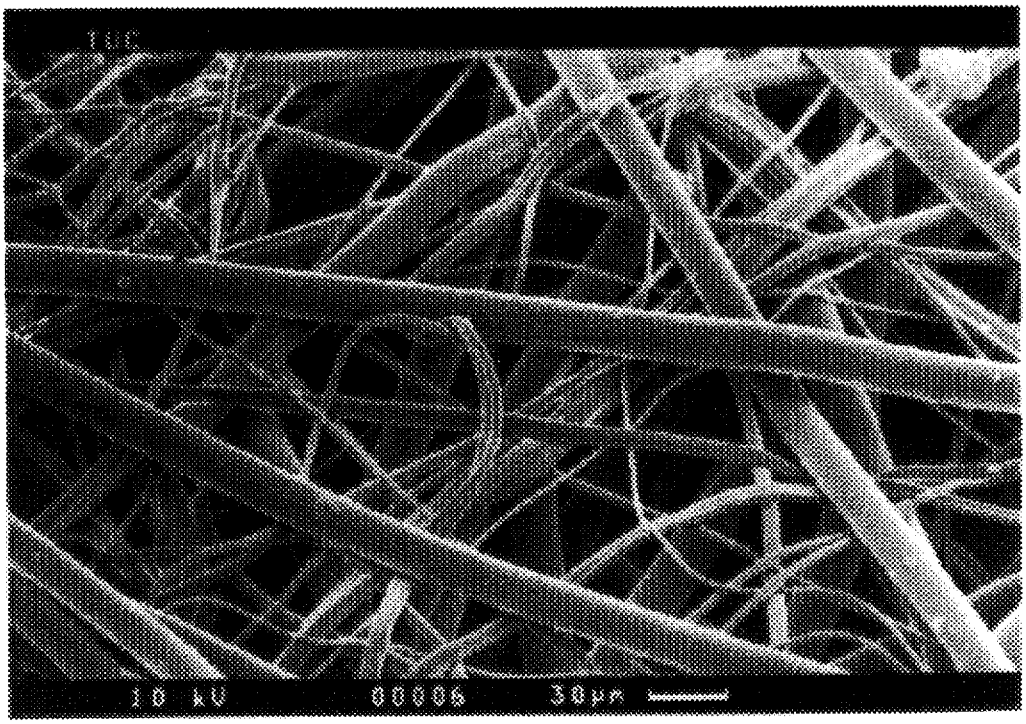
FIG. 5 is a photograph which illustrates the appearance of an internal portion of a representative fibrous non-woven composite in accordance with the present invention. The photograph was obtained with the use of an electron microscope with the scale in microns being provided at the bottom of the photograph. Both the continuous coarse filaments and the fine discontinuous microfibers are shown to be in good admixture. The discontinuous microfibers are shown to be both above and below fine discontinuous microfibers. There are no discrete boundaries between substantially homogeneous concentrations of the two fibrous components. The two components are well intermingled in a substantially random manner. No area of thermal bonding is shown in this photograph.
Figure 6:
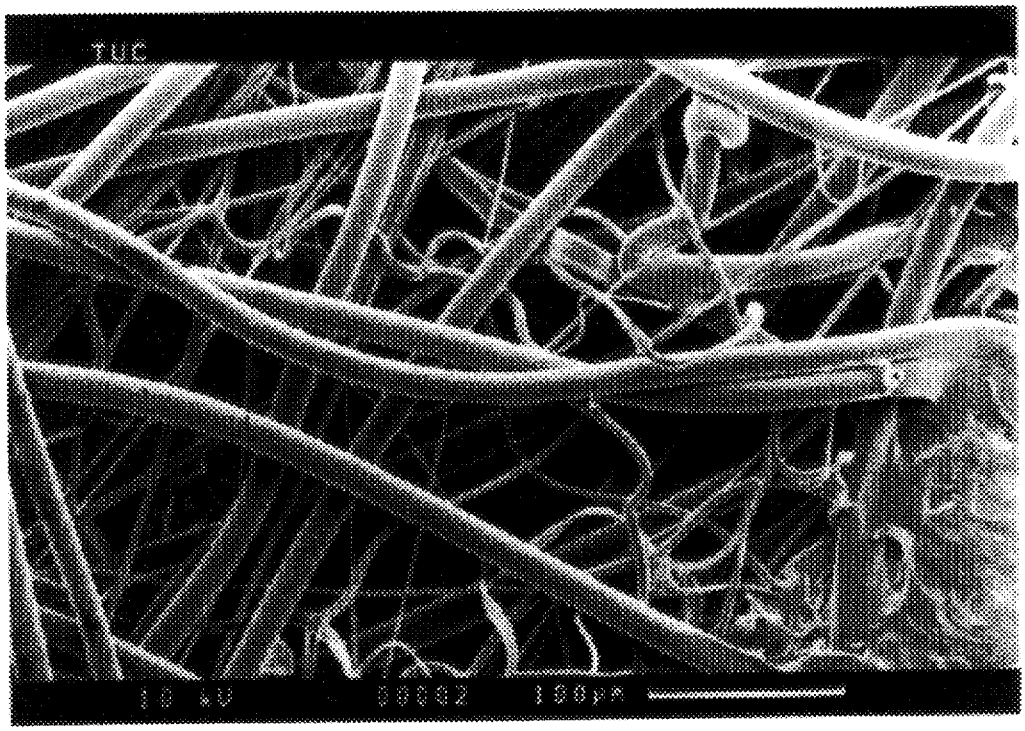
FIG. 6 is another photograph which illustrates the appearance of an internal portion of a representative fibrous non-woven composite in accordance with the present invention obtained with the use of an electron microscope that is similar to that of FIG. 5 with the exception that it was prepared while using a lesser magnification. The scale in microns is provided at the bottom of the photograph. The intermingling of the two diverse fibrous components is apparent. There are no discrete boundaries between substantially homogeneous concentrations of the two fibrous components. At the lower right corner of the photograph an area where thermal point-bonding has taken place is apparent.

A representative internal structure of the resulting non-woven composite is shown in FIGS. 5 and 6 as previously discussed. Thus, the resulting composite is a thermally bonded non-woven sheet material produced following sequential or simultaneous melt extrusion (as described) using an integrated non-woven formation technique on the same deposition device of a non-woven spinning system.

The invention is not restricted to the two-component embodiment described by way of this Example and the resulting non-woven composite optionally can be formed while utilizing more than two components in a directly analogous manner. Additionally, for special end uses a substantially homogeneous concentration of either component or a different component can be provided or otherwise placed upon the surface of the fibrous non-woven composite of the present invention when such presence would be advantageous. For instance, a substantially homogeneous concentration of the substantially continuous coarse spun-bonded filaments can be provided when only the upper portion of the web formed from the same is penetrated by the fine melt-blown microfibers to form the fibrous non-woven composite described herein and a portion of the substantially coarse filaments remains below as a homogeneous area. Alternatively, a discrete layer of either component can be deposited upon the surface of the composite article of the present invention via melt extrusion.

The fields of use for the new composite vary depending upon the particular materials and their relative concentrations employed, and include medical and clothing applications in particular. The fibrous non-woven composite formed in this Example is particularly suited for use as a barrier leg cuff or for use in a diaper, etc.

Although the invention has been described with a preferred embodiment, it is to be understood that variations and modifications may be resorted to as will be apparent to those skilled in the art. Such variations and modifications are to be considered within the purview and scope of the claims appended hereto.

We claim:

1. A fibrous spun-bonded non-woven composite web having an upper surface and a lower surface consisting essentially of in admixture:

(a) as a first component substantially continuous coarse spun-bonded non-crimped filaments of a thermoplastic polymer having a diameter greater than 15 μm. and which exhibit molecular orientation, and (b) as a second component fine discontinuous melt-blown microfibers of a thermoplastic polymer having a diameter less than 10 μm. which exhibit no substantial molecular orientation, wherein said first and second components of said fibrous spun-bonded bonded non-woven composite were deposited following melt extrusion on the same equipment to produce a substantially random admixture of the fibers of said components extending from the upper surface to the lower surface of the resulting web throughout said web in the absence of a discrete phase boundary between substantially homogeneous concentrations of said components thereby creating an integrated non-woven deposition of said components, and said integrated non-woven deposition of said components is thermally bonded to form said spun-bonded non-woven composite web which exhibits a unitary structure.

* * * * *